US006460615B1

(12) United States Patent
Heijnen

(10) Patent No.: US 6,460,615 B1
(45) Date of Patent: Oct. 8, 2002

(54) PIPE EXPANSION DEVICE

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/724,082

(22) Filed: Nov. 28, 2000

(30) Foreign Application Priority Data

Nov. 29, 1999 (EP) ..... 99309532

(51) Int. Cl.[7] ..... E21B 29/00
(52) U.S. Cl. ..... 166/55; 166/207
(58) Field of Search ..... 166/277, 55, 207, 166/297

(56) References Cited

U.S. PATENT DOCUMENTS 6,012,523 A * 1/2000 Campbell et al. ..... 166/277

FOREIGN PATENT DOCUMENTS

| | | |
|---|---|---|
| EP | 146331 | 6/1985 |
| EP | 418620 | 3/1991 |

* cited by examiner

*Primary Examiner*—William Neuder

(57) ABSTRACT

A device for expanding a pipe comprising a bi-conical sleeve having a first section and a second section, which sections are provided with at least two longitudinal guide channels, first wedges, wherein each first wedge tapers into the direction in which the first section widens and is provided with a support element that co-operates with the corresponding longitudinal guide channel of the first section, second wedges, wherein each second wedge tapers into the direction in which the second section widens and is provided with a support element that co-operates with the corresponding longitudinal guide channel of the second section, and means for moving the wedges into each other.

2 Claims, 1 Drawing Sheet

PIPE EXPANSION DEVICE

FIELD OF THE INVENTION

The present invention relates to a device for expanding a pipe, such as a casing string or a liner in a borehole.

BACKGROUND TO THE INVENTION

Pipe expansion is done to increase the diameter of a pipe, this is particular relevant to a well completion, wherein a number of casing strings is introduced into a borehole to protect the borehole from collapsing and to contain the well fluids therein. In such a completion each next casing string has a smaller diameter than the preceding one, in order that the next casing string can be put in place. Consequently the cross-section available to fluid flow through the completion becomes smaller and smaller as the number of casing strings increases. And this adversely affects the production from the well. To overcome this the casing strings are expanded so that the overall internal diameter of the well completion is not reduced.

Pipe expansion is achieved by displacing through the pipe an expansion device having a larger diameter than the inner diameter of the pipe. Because the forces exerted on the expansion device during pipe expansion are large, such expansion devices have fixed dimensions. And this implies that the expansion has to be performed in stages.

It is an object of the present invention to provide a device for expanding a pipe to the same diameter as the pipe through which the pipe to be expanded is run. It is a further object of the present invention to provide a device of which outer diameter can easily be adjusted, and that is sufficiently strong to withstand the forces that it subjected to during the pipe expansion.

SUMMARY OF THE INVENTION

To this end the device for expanding a pipe according to the present invention comprises a bi-conical sleeve having a first section widening from one end of the bi-conical sleeve to the middle and a second section widening from the opposite end of the bi-conical sleeve to the middle, which sections are provided with at least two longitudinal guide channels which guide channels in the second section are staggered in relation to the guide channels in the first section, a set of first wedges, wherein each first wedge tapers into the direction in which the first section widens and is provided with a support element that co-operates with the corresponding longitudinal guide channel of the first section, a set of second wedges, wherein each second wedge tapers into the direction in which the second section widens and is provided with a support element that co-operates with the corresponding longitudinal guide channel of the second section, and means for moving the sets of wedges into each other.

BRIEF DESCRIPTION OF THE FIGURES

The invention will now be described by way of example in more detail with reference to the accompanying drawing, wherein.

DETAILED DESCRIPTION OF THE INVENTION

Figure 1:
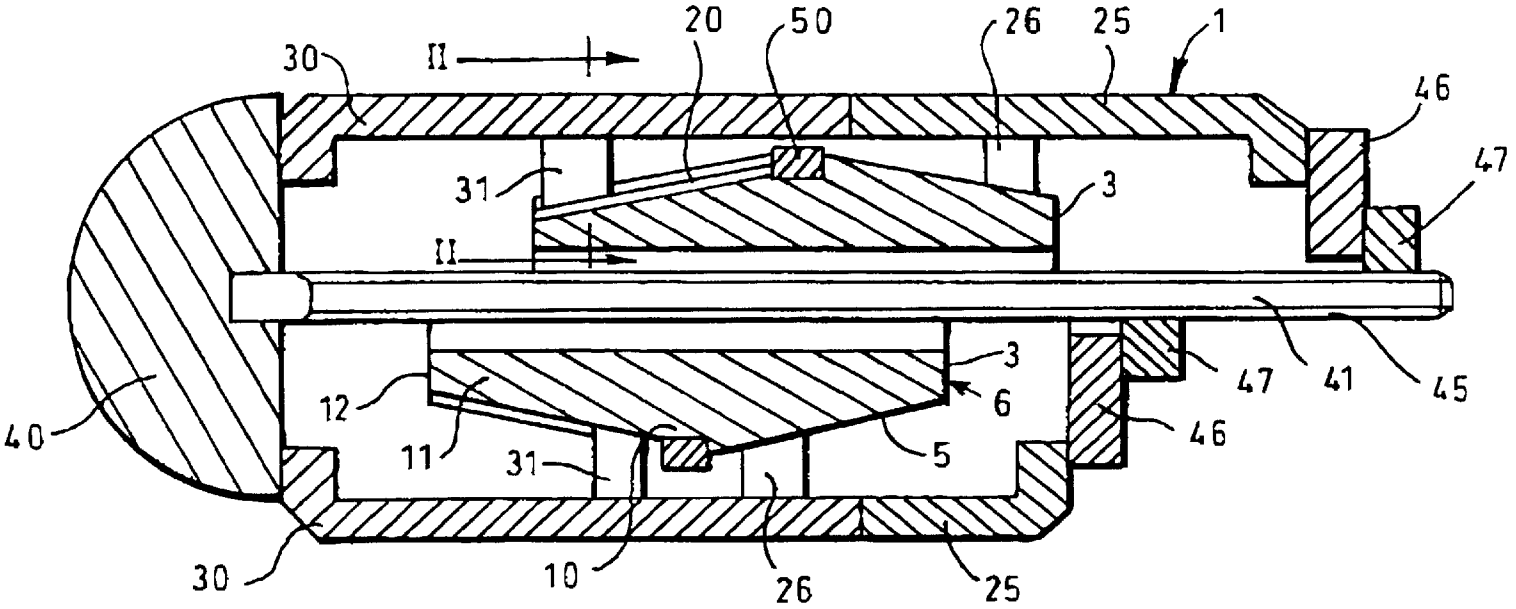
FIG. 1 shows schematically a longitudinal section of the device according to the present invention in an initial position and in an expanded position.
Figure 2:
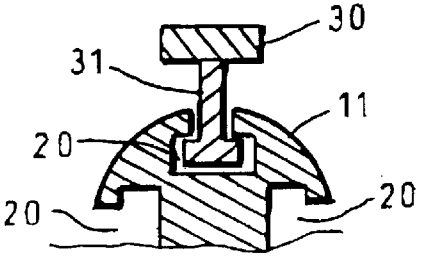
FIG. 2 shows a cross-section along line II—II of FIG. 1 drawn to a different scale.

Reference is made to the Figures. The device 1 for expanding a pipe (not shown) according to the present invention comprises a bi-conical sleeve 3. The bi-conical sleeve 3 consists of two sections, a first section 5 widening from one end 6 of the bi-conical sleeve 3 to the middle 10 and a second section 11 widening from the opposite end 12 of the bi-conical sleeve 3 to the middle 10.

Each of the sections 5 and 11 is provided with four longitudinal guide channels 20, distributed evenly about the circumference of the sections of the bi-conical sleeve 3. For reasons that will be explained below, the guide channels 20 in the second section 11 are staggered in relation to the guide channels (not shown) in the first section 5.

The device 1 further comprises a set of first wedges 25, wherein each first wedge 25 tapers into the direction in which the first section 5 of the bi-conical sleeve 3 widens. Each of the first wedges 25 is provided with a support element 26 that co-operates with the corresponding longitudinal guide channel of the first section 5.

The device 1 further comprises a set of second wedges 30, wherein each second wedge 30 tapers into the direction in which the second section 11 of the bi-conical sleeve 3 widens. Each of the second wedges is provided with a support element 31 that co-operates with the corresponding longitudinal guide channel 20 of the second section 11.

The reason that the guide channels 20 in the second section 11 are staggered in relation to the guide channels (not shown) in the first section 5, is that the wedges 25 and 30 can slide with respect to each other as the fingers of two hands when the hands are moved into each other.

The device 1 further comprises means for moving the sets of wedges 25 and 30 into each other. These means comprise a front end part 40, a connection rod 41 secured with one end in the front end part 40 and provided at the other end with a screw thread 45. At the other end of the device 1, the means comprise a ring 46 and a nut 47 cooperating with the screw thread 45 on the connection rod 41.

When the device 1 is being put in place in the pipe (not shown) to be expanded, the nut 47 is at the end of the connection rod 41. This position is shown in the upper half of FIG. 1. In this running position, the outer diameter of the device 1 is so that the device 1 can be displaced through the pipe.

In order to expand the pipe, torsion is applied on the nut 47, so that it is rotated in a direction so that the nut 47 moves towards the front end part 40 over the screw threads. The tapering wedges 25 and 30 are pushed by the ring 46 into each other, and the support elements 26 and 31 move towards each other in the longitudinal guide channels. Because the longitudinal guide channels are parallel to the outer surface of sections of the bi-conical sleeve 3 in which the guide channels are arranged, the support elements also move outwards in a radial direction. And consequently the wedges 25 and 30 move outwards as well. This expanded position is shown in the lower half of FIG. 1.

In this expanded position the device 1 can be pushed through the pipe, for example by means fluid pressure exerted on a piston (not shown) that acts on the ring 46.

The tapering wedges 25 and 30 are in contact which each other along their edges. Therefore the tapering wedges 25 and 30 support each other, and in this way sufficient support is provided so that the device according to the present invention provides sufficient collapse resistance to withstand the forces that it subjected to during the pipe expansion. Moreover, the outer diameter of the device can easily be adjusted.

To prevent the device 1 from expanding too far, the bi-conical sleeve 4 can be provided with a ring 50 in the middle 10.

By adjusting the nut 47, the diameter can be adjusted, and this can easily be done without removing the device from the pipe.

It will be understood that there is a one-to-one relationship between the wedges and the guide channels, because for each tapering wedge there is a guide channel.

Suitably the number of guide channels, and consequently wedges is in the range of from 2 to 8, and suitably in the range of from 4 to 6. By selecting the number of wedges, the device according to the present invention can be made is sufficiently strong to withstand the forces that it subjected to during the pipe expansion.

I claim:

1. A device for expanding a pipe, which device comprises:

a bi-conical sleeve having a first section widening from one end of the bi-conical sleeve to the middle and a second section widening from the opposite end of the bi-conical sleeve to the middle, which sections are provided with at least two longitudinal guide channels which guide channels in the second section are staggered in relation to the guide channels in the first section;

a set of first wedges, wherein each first wedge tapers into the direction in which the first section widens and is provided with a support element that co-operates with the corresponding longitudinal guide channel of the first section;

a set of second wedges, wherein each second wedge tapers into the direction in which the second section widens and is provided with a support element that co-operates with the corresponding longitudinal guide channel of the second section; and means for moving the sets of wedges into each other.

2. The device of claim 1, wherein the sections are provided with between two and eight longitudinal guide channels.

* * * * *